US005722362A

United States Patent [19]

Takano et al.

[11] Patent Number: 5,722,362

[45] Date of Patent: Mar. 3, 1998

[54] DIRECT INJECTION SYSTEM ENGINE CONTROLLING APPARATUS

[75] Inventors: Yoshiya Takano, Hitachinaka; Mamoru Fujieda, Tomobe-machi; Kousaku Shimada, Hitachinaka, all of Japan

[73] Assignee: Hitachi, Ltd., Japan

[21] Appl. No.: 721,036

[22] Filed: Sep. 26, 1996

[30] Foreign Application Priority Data

Sep. 29, 1995 [JP] Japan ..... 7-252411

[51] Int. Cl.[6] ..... F02D 41/04; F02B 17/00

[52] U.S. Cl. ..... 123/295; 123/399; 123/679

[58] Field of Search ..... 123/295, 305, 123/350, 419, 436, 435, 399, 679

[56] References Cited

U.S. PATENT DOCUMENTS

| | | | |
|---|---|---|---|
| 5,018,498 | 5/1991 | Hoover | 123/435 |
| 5,078,107 | 1/1992 | Morikawa | 123/295 |
| 5,078,109 | 1/1992 | Yoshida et al. | 123/350 |
| 5,282,449 | 2/1994 | Takahashi et al. | 123/350 |
| 5,391,127 | 2/1995 | Nishimura | 477/110 |
| 5,458,102 | 10/1995 | Tomisawa et al. | 123/435 |

FOREIGN PATENT DOCUMENTS 4-241754 8/1992 Japan .

*Primary Examiner*—Willis R. Wolfe
*Assistant Examiner*—Hieu T. Vo
*Attorney, Agent, or Firm*—Evenson, McKeown, Edwards & Lenahan, P.L.L.C.

[57] ABSTRACT

A target torque map is determined by an engine rotation number and an acceleration pedal opening degree. Plural control constant groups are provided to correspond the respective target torque map. A fuel precedent control is carried out by the plural constant control groups. By detecting an engine combustion condition, under a worse combustion condition a transfer to a higher torque side is carried out with a time function according to a complementary control of the control constant group. In a direct injection system engine, a controlling apparatus in which a stratified combustion and a homogeneous stoichiometric combustion are easily and stably.

12 Claims, 11 Drawing Sheets

ACCELERATION PEDAL OPENING DEGREE ↑ OPEN

| | | | | | | | |
|---|---|---|---|---|---|---|---|
| 14.7 | 14.7 | 14.7 | 14.7 | 14.7 | 14.7 | 14.7 | 14.7 |
| 14.7 | 14.7 | 14.7 | 14.7 | 14.7 | 14.7 | 14.7 | 14.7 |
| 30 | 30 | 30 | 30 | 30 | 30 | 14.7 | 14.7 |
| 30 | 30 | 30 | 30 | 30 | 30 | 14.7 | 14.7 |
| 40 | 40 | 40 | 40 x | 30 | 30 | 14.7 | 14.7 |
| 40 | 40 | 40 | 40 | 30 | 30 | 14.7 | 14.7 |
| 40 | 40 | 40 | 40 | 30 | 30 | 14.7 | 14.7 |

ENGINE ROTATION → HIGH

DIRECT INJECTION SYSTEM ENGINE CONTROLLING APPARATUS

BACKGROUND OF THE INVENTION

The present invention relates to a direct injection system engine controlling apparatus and, in particularly to a direct injection system engine controlling apparatus wherein one of plural control constant groups is selected in accordance with a detected operation condition of an engine, thereby a good control direct injection system engine having a controlling means is performed according to the plural control constant groups.

The present invention relates to a direct injection system engine controlling apparatus and, in particularly to a direct injection system engine controlling apparatus wherein in accordance with a target torque determined by an operation condition of an engine, a good control direct injection system engine having a controlling means is performed according to one of plural control constant group which corresponds to a predetermined target torque.

In a conventional controlling system for a direct injection system engine, a direct injection system internal combustion engine is disclosed, for example, as shown in Japanese patent laid-open publication No. 241,754/1992.

In the above stated conventional direct injection system internal combustion engine, in case that a combustion chamber temperature in an engine is low, a change-over operation from a stratified combustion condition to a homogeneous stoichiometric combustion condition is carried out at a low engine load and low engine rotation number area.

As a result, an improved emission level (an improved exhaust gas emission) of the engine is attained in the conventional direct injection system internal combustion engine, and further a generation of a smoke (a soot or a black smoke) in the direct injection system internal combustion engine is prevented.

In the present invention, the stratified combustion is defined as two regions, for example, and one of these regions comprises a region having a rich air-fuel ratio such as a dense A/F=10 to burn the fuel and another of these regions comprises a region having a lean rich air-fuel ratio such as a mean A/F=40.

The most essential point in the conventional direct injection system internal combustion engine resides in that as stated in above the stratified combustion is able to carry out and then a wide improvement for a fuel consumption can expect in comparison with a previous conventional direct injection system internal combustion engine.

However, taking an aspect from an actual running operation condition of a vehicle or an automobile, in the direct injection system internal combustion engine, it is necessary to correspond to a high engine output demand by a driver and further at a high engine rotation number and high engine load area it is not always necessarily say that the stratified combustion is most suitable for a protection of the engine.

In the above stated conventional direct injection system internal combustion engine, the change-over operation from the stratified combustion condition to the homogeneous stoichiometric combustion condition is carried out taking into a consideration under the combustion chamber temperature.

However, in the above conventional direct injection system internal combustion engine, a direct injection system internal combustion engine controlling apparatus having following concrete elements does not appear.

One of the concrete elements is a direct injection system internal combustion engine controlling apparatus under the operation condition according to the demand of the vehicle or the automobile through the driver. Another of the concrete elements is, in particular, a direct injection system internal combustion engine controlling apparatus for securing a stable combustion condition under the stratified combustion area.

SUMMARY OF THE INVENTION

An object of the present invention is to provide a direct injection system engine controlling apparatus wherein at an area for regarding a fuel consumption as important, at an area for reflecting a more high engine output intention of a driver and at an area for considering an engine protection, a stratified combustion, an air-fuel ratio combustion for corresponding to a normal lean burn combustion and a homogeneous stoichiometric combustion can be carried out stably and accurately.

Another object of the present invention is to provide a direct injection system engine controlling apparatus wherein a stratified combustion condition can be maintained always at a stable combustion condition.

According to the present invention, a direct injection system engine controlling apparatus comprises a fuel supplying means for directly supplying a fuel to a cylinder of an engine, an inhale air amount controlling means for controlling an amount of an inhale air which is inhaled into the cylinder, an igniting means for igniting a mixture material of the fuel and the air in the cylinder, and a controlling means for controlling at least one of the fuel supplying means, the inhale air amount controlling means, and the igniting means.

The above stated object of the present invention is attained in the direct injection system engine controlling apparatus in which, by a provision of an operation detecting means for detecting an operation condition of the engine, one of the plural control constant groups is selected in accordance with the detected operation condition detected by the operation condition detecting means. In this invention, the plural control constant groups store a map, a constant, and a table for use in the controlling means.

The above stated object of the present invention is attained in the direct injection system engine controlling apparatus in which in response to the operation condition of the vehicle or the automobile the target torque or the target air-fuel ratio is determined by the engine rotation number and the acceleration pedal opening degree being the driver's intention and the fuel precedent control is carried out according to one of the plural control constant group which is determined by the respective target torque or the respective target air-fuel ratio.

The above stated object of the present invention is attained in the direct injection system engine controlling apparatus in which the engine combustion condition is observed always and the complementary of the plural control constant groups and the time function during the complementary are provided in response to the combustion condition of the engine, further the learning control is performed according to the obtained result.

In the present invention, the target torque or the target air-fuel ratio is set according to the engine rotation number and the acceleration pedal opening degree which reflect the driver's intention. The control constant group for corresponding to the target torque or the target air-fuel ratio is set in advance and the direct injection system engine controlling apparatus is controlled by the respective control constant group.

One of the plural control constant groups is able to carry out the stratified combustion which is considered from the fuel consumption as important. And another of the plural control constant group is able to carry out the homogeneous stoichiometric combustion which is considered from the high engine output and the engine protection.

In the present invention, the direct injection system engine controlling apparatus has the control constant group which corresponds to the intermediate target torque, such as in the air-fuel ratio combustion corresponding to the lean burn combustion, and the respective control constant group is able to function to operate the stable combustion at the respective target torque area or at the respective target air-fuel ratio area.

In the present invention, the direct injection system engine controlling apparatus has the complementary control of the control constant group. When the worse combustion condition phenomenon or the generation of the combustion aggravation condition is detected, between other or separate control constant groups (the target torque becomes to direct high), the complementary control is carried out and the stable combustion is always secured.

At the same time, since the time function is provided on the complementary control for the control constant group, the control for restraining the abrupt change of the target torque or the target air-fuel ratio can carried out.

By the provision of the learning function, namely the complementary result for changing the target torque or target air-fuel ratio is reflected in the next control, in case the same operation condition appears again, the stable control operation of the direct injection system engine can functioned.

DESCRIPTION OF THE INVENTION

Hereinafter, one embodiment of a direct injection system engine controlling apparatus according to the present invention will be explained in detail referring to an illustrated embodiment.

Figure 1:
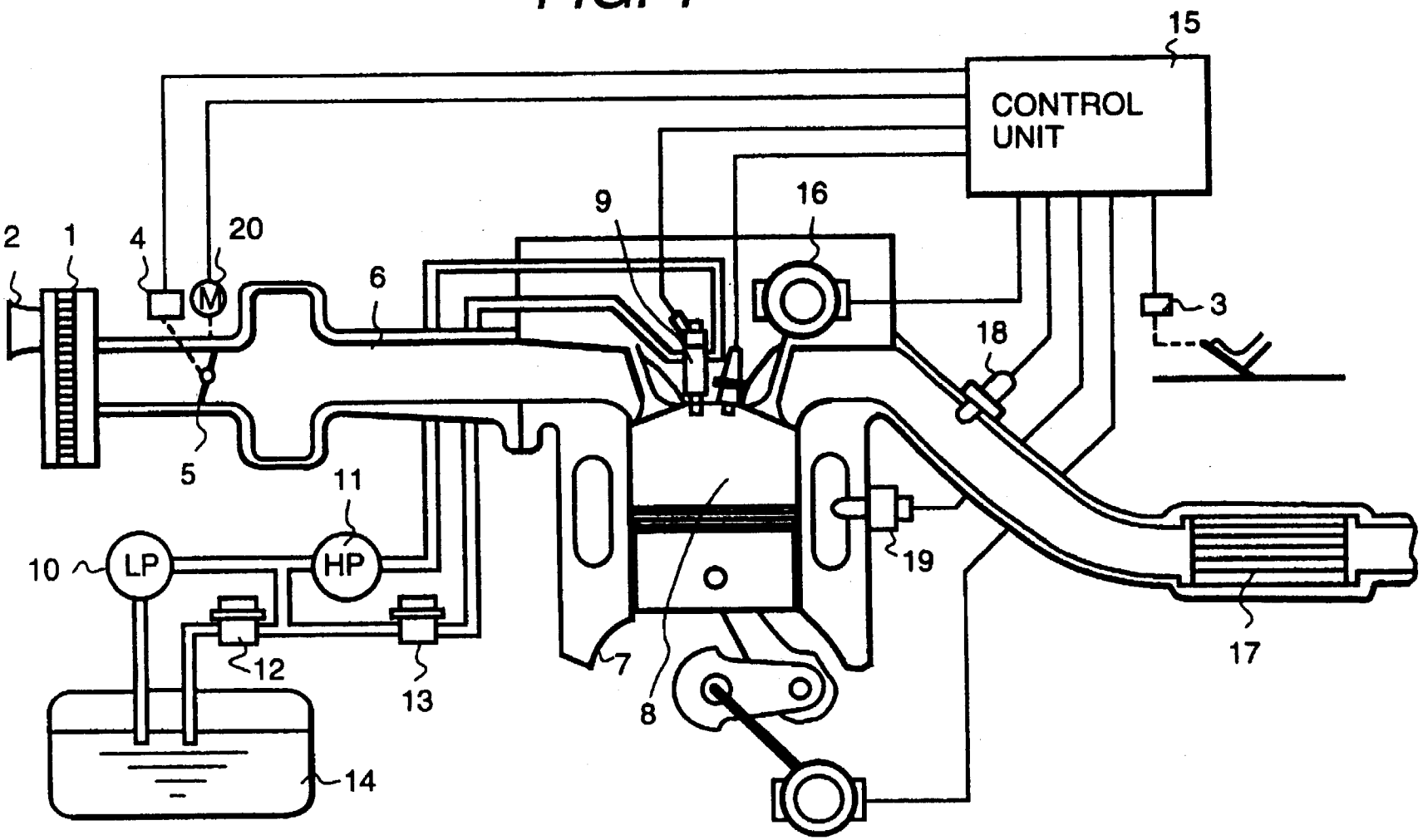
FIG. 1 is one example showing a direct injection system engine system in which one embodiment of a direct injection system engine controlling apparatus according to the present invention is applied.

FIG. 1 shows one example of an engine system of a direct injection system engine controlling apparatus where the present invention is adopted.

The engine system of the direct injection system engine controlling apparatus comprises mainly an air cleaner 1, an inlet portion 2 of the air cleaner 1, an acceleration sensor 3 for detecting an acceleration pedal step-in amount, a throttle valve 5 for controlling an intake flow amount, a throttle valve opening degree detecting sensor 4 for detecting an opening degree of the throttle valve 5, a collector 6, a combustion chamber 8, a direct injection system engine 7, and an injector 9.

The engine system of the direct injection system engine controlling apparatus comprises mainly further a first fuel pump 10 for preliminary pressurizing the fuel, a second fuel pump 11 for secondary pressurizing the fuel, a first fuel pressure regulator 12, a second fuel pressure regulator 13, a fuel tank 14, a control unit 15, a crank angle sensor 16, a catalyst member 17, a temperature detecting sensor 18, a water temperature detecting sensor 19, and a motor 20 connected to the throttle valve 5.

In the engine system shown in FIG. 1, the air inhaled by the engine 7 is taken from the inlet portion 2 of the air cleaner 1. The air passes into a throttle body which receives the throttle valve 5 for controlling an intake air flow amount and further the air enters into the collector 6.

In the collector 6, the intake air is distributed to each of intake manifolds which are connected to each of cylinders of the engine 7 and after that the air is introduced into the cylinder.

On the other hand, the fuel such as a gasoline is primarily pressurized by the first fuel pump 10 through the fuel tank 14 and the fuel further secondarily pressurized by the second fuel pump 11 and after that the fuel is supplied to a fuel system where the injector 9 is installed through a piping structure.

The fuel primarily pressurized is pressure-regulated at a constant pressure value (for example, 3 kg/cm$^2$) by the first fuel pressure regulator 12. The fuel secondarily pressurized having the pressure value higher than the pressure value of the primarily pressurized fuel is pressure-regulated at a constant pressure (for example, 30 kg/cm$^2$) by the second fuel pressure regulator 13. And the fuel is injected into the respective cylinder from the injector 9 which is provided on the respective cylinder.

The throttle valve opening degree detecting sensor 4 for detecting an opening degree of the throttle valve 5 is provided on the throttle body and an output of the throttle valve opening degree detecting sensor 4 is inputted into the control unit 15.

The throttle valve 5 detects the opening degree of the acceleration sensor 3 for detecting an acceleration pedal step-in amount which is an intention of a driver. This throttle valve 5 is constituted as a throttle actuator (an apparatus for electrically or electronically controlling the throttle valve 5) which is controlled by the motor 20 connected to the throttle valve 5 according to a control signal from the control unit 15.

Next, the crank angle sensor 16 is mounted on a cam shaft and outputs a reference angle signal (REF) for indicating a rotational position of a crank shaft and a position angle signal (POS) for detecting a rotational signal (an engine rotation number).

These signals of the reference angle signal (REF) and the rotational and positional angle signal (POS) are inputted into the control unit 15. Herein, the crank angle sensor 16 may employ a type for directly detecting the rotation of the crank shaft.

The temperature detecting sensor 18 is provided on an exhaust pipe. Both of outputs of the temperature detecting sensor 18 and the water temperature detecting sensor 19 are inputted into the control unit 15.

Figure 2:
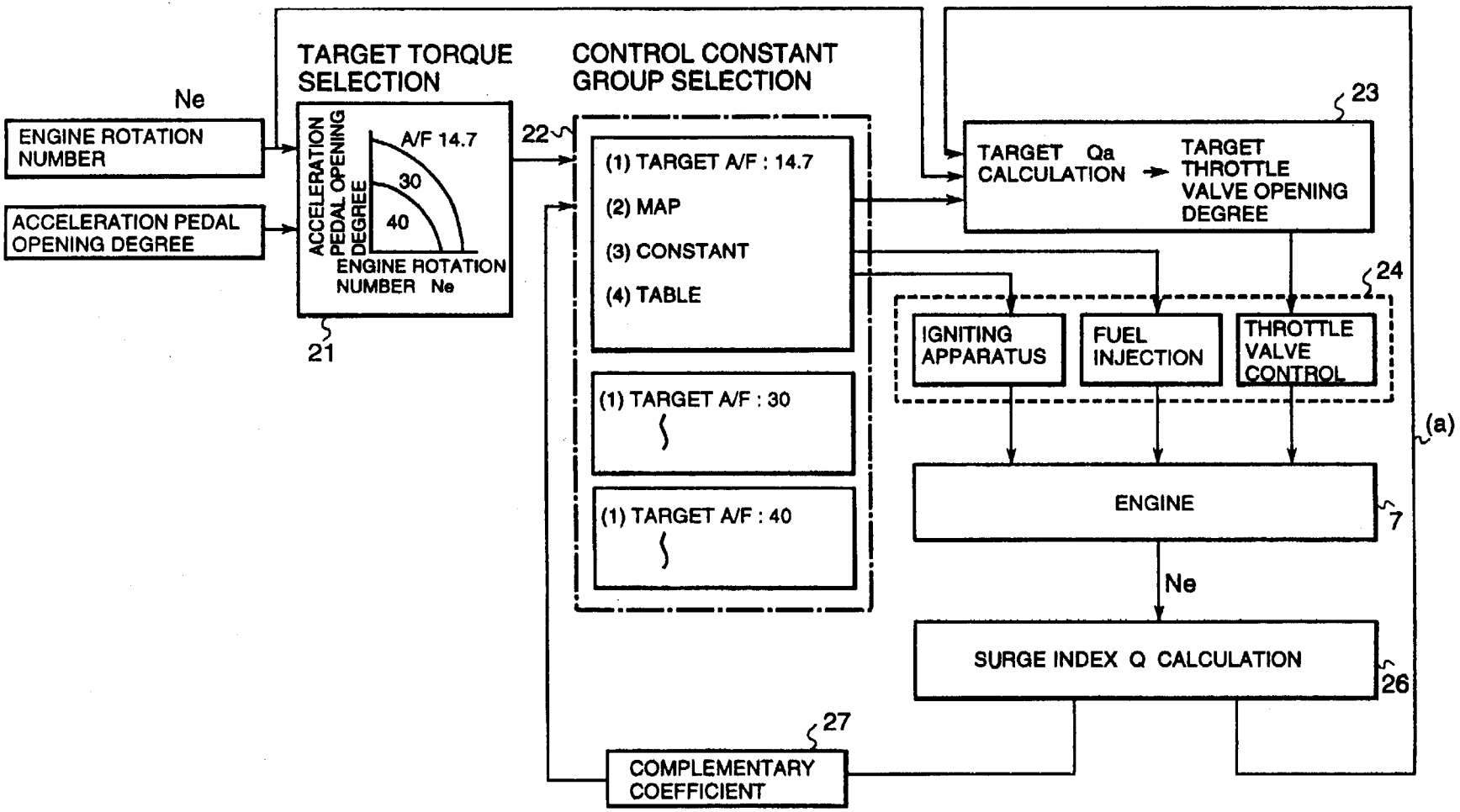
FIG. 2 is a control block diagram showing one embodiment of a direct injection system engine controlling apparatus according to the present invention.

Next, FIG. 2 shows a whole controlling block diagram of one embodiment of the direct injection system engine controlling apparatus according to the present invention.

First of all, in a block 21 a target torque or a target air-fuel ratio of the operation conditions is requested according to an engine rotation number (Ne) of the engine 7 and an acceleration pedal opening degree being a driver's intention detected by the acceleration sensor 3.

Herein, the target torque is set as a target air-fuel ratio and, in the present invention, the target torque is set as a stratified combustion having an air-fuel ratio 40 (A/F=40) at an area of a low engine rotation number and a low engine load from an aspect taking a serious view of the fuel consumption or from an aspect regarding the fuel consumption as important.

Further, at a high engine load side, it is necessary to correspond a high engine output requirement requested by the driver. In the present invention, the target torque is set to have an air-fuel ratio 30 (A/F=30). In a high engine rotation number and high engine load area, the homogenous stoichiometric combustion area is set to protect the engine 7.

Next, in a block 22, the target torque or the target air-fuel ratio is determined and after that, from a control constant group corresponded to a respective target torque, a predetermined control constant search and determination is performed.

In this embodiment of the present invention, the control constant group selection is carried out by one selecting form a map, a constant and a table, for example, for use in the control unit 15. The map, the constant or the table has an injection pulse width Ti setting, a combustion injecting period time setting, and an ignition period time setting, each of which corresponds to the target air-fuel ratio, however it is not limited to these.

Next, in a block 23, under the basis of the target air-fuel ratio, a calculation about a necessary air flow amount and a calculation about a target throttle valve opening degree for attaining the necessary air flow amount for the engine 7 are carried out.

Figure 3:
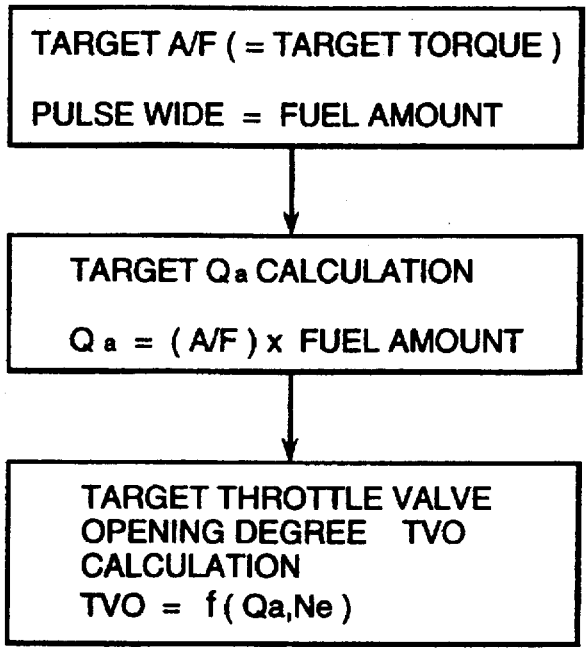
FIG. 3 is a basic flow chart of a fuel precedent control system showing one embodiment of a direct injection system engine controlling apparatus according to the present invention.

As shown in FIG. 3, when the target air-fuel ratio and a drive pulse width of the injector 9 at this target air-fuel ratio are determined, a target air flow amount Qf is determined under a following formula.

$$Qf=(A/F)\times(\text{fuel amount})=(A/F)\times(\text{pulse width}))$$

An air flow amount (Qa) for passing through the throttle valve 5 is determined by an engine rotation number (Ne) and a throttle valve opening degree (=an opening area) at this air flow amount, a target throttle valve opening degree (TVO) is given as a function of a following formula.

$$TVO=f(Qa, Ne)$$

In a block 24, the throttle valve 5 is controlled by the throttle valve opening degree calculated by the block 23, at the same time an ignition control operation at the ignition period time determined by the block 22 and the fuel injection operation (the injector drive operation) at the injection period time are carried out.

The engine 7 is operated according to the combustion control and the ignition control in the block 24, as a result, the engine 7 generates a predetermined engine drive torque and a predetermined engine rotation number.

The construction stated in the above corresponds to a part of one problem of the present invention and by providing the plural control constant groups corresponding to the target torque or the target air-fuel ratio the engine control is carried out using the respective suitable control constant.

The above construction satisfies the requirements about the fuel consumption and the engine output etc.. The setting of the target torque or the target air-fuel ratio is constituted to optionally set by adapting the characteristics for the vehicle or the automobile.

Next, the construction about a part corresponding to another problem of the present invention will be explained.

In the embodiment of the present invention, in a block 26 where an estimation for the engine combustion condition is carried out according to a surge index, and the engine combustion condition is detected under the basis of the engine rotation number.

According to the basis of the result of the detected combustion condition of the engine 7, in case that the control continuation of the throttle valve opening degree and the engine combustion condition is apt to worsen, in a block 27 a complementary coefficient is calculated. On the basis of the complementary coefficient the amendment of the target torque or the target air-fuel ratio is carried out, thereby the engine control is able to carry out under the stable operation condition.

In the embodiment according to the present invention, the stable index of the engine combustion is judged through the surge index Q, this will be explained in detail in a latter portion, however it is not limited to this method.

Figure 4:
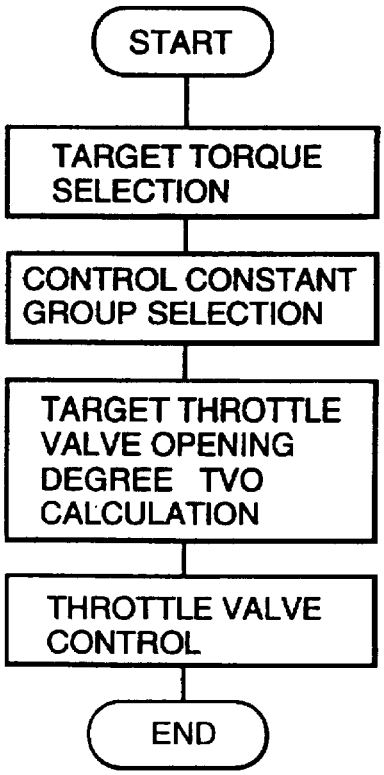
FIG. 4 is a basic flow chart showing the control block diagram of FIG. 2.

To arrange the above stated construction, as shown in FIG. 4, the selection of the target torque, the selection of the control constant group, the calculation of the target throttle valve opening degree, and the throttle valve control using the target throttle valve opening degree constitute a main routine.

Figure 5:
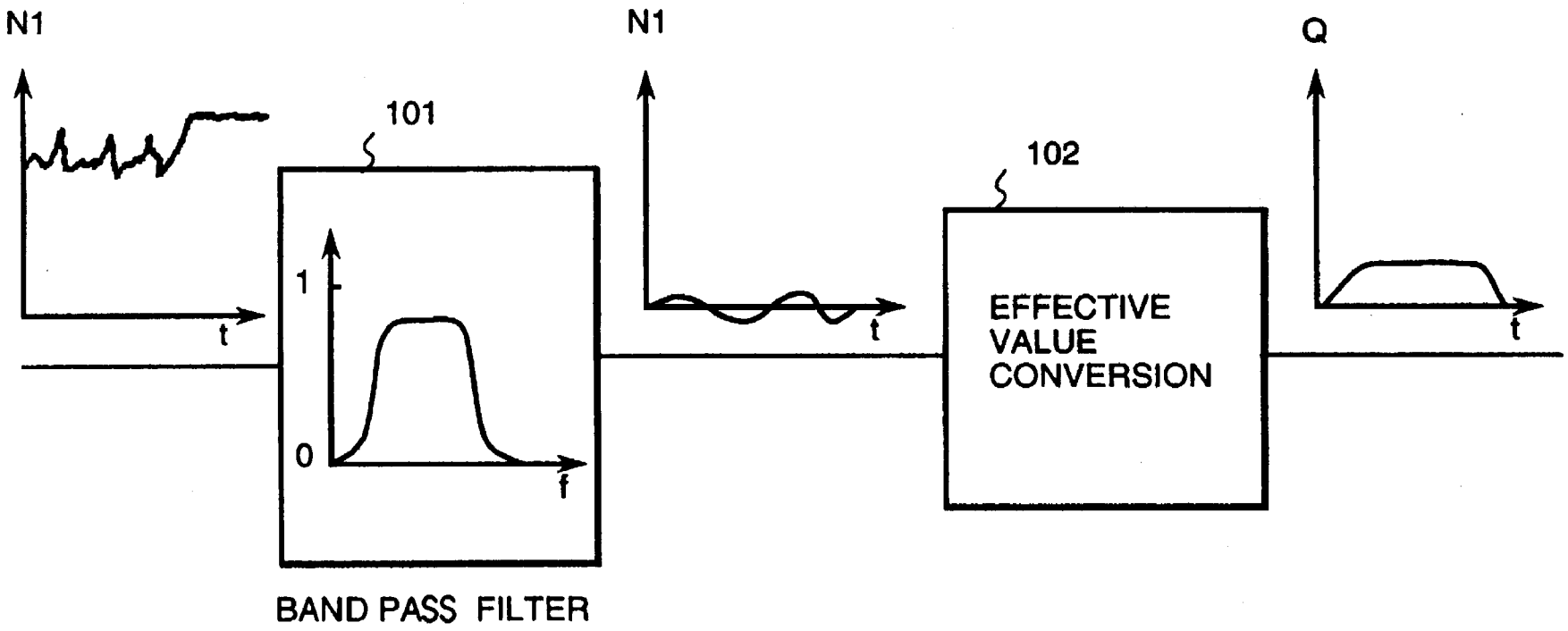
FIG. 5 is a surge index control block diagram showing one embodiment of a direct injection system engine controlling apparatus according to the present invention.

Next, detail control contents of the respective block will be explained. First of all, the surge index Q in the block 26 will be explained referring to FIG. 5.

Firstly, the engine rotation number (Ne) is inputted into a band pass filter 101. A transmission frequency of the band pass filter is about 1 Hz–9 Hz, for example.

A signal passed through the band pass filter 101 becomes a component having only surge torque and this component is converted to an effective value by an effective value converting means 102. As stated in above, the surge index Q for indicating the surge-torque (a torque fluctuation for causing the vibration of the engine 7 in before and behind) is obtained.

Figure 6:
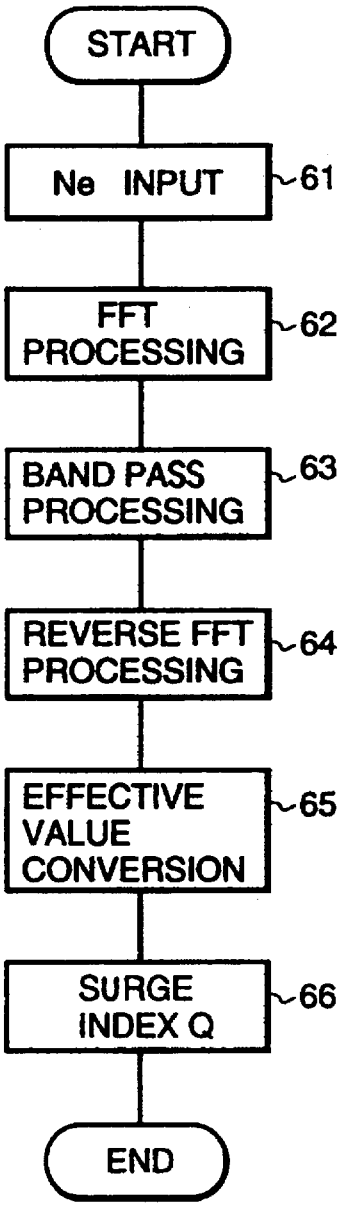
FIG. 6 is a control flow chart showing the surge index control block diagram of FIG. 5.

In concretely, as shown in FIG. 6, an input of the engine rotation number (Ne) is carried out in a processing 61, an extraction of the frequency component under FFT processing is carried out in a processing 62, and further the band pass processing within a predetermined range is carried out in a processing 63, respectively.

A reversal FFT processing is carried out in a processing 64 and it returns again to a data on a time axis. Further, the effective value conversion execution is carried out in a processing 65 and the calculation of the surge index Q is carried out in a processing 66.

Figures 17, 18:
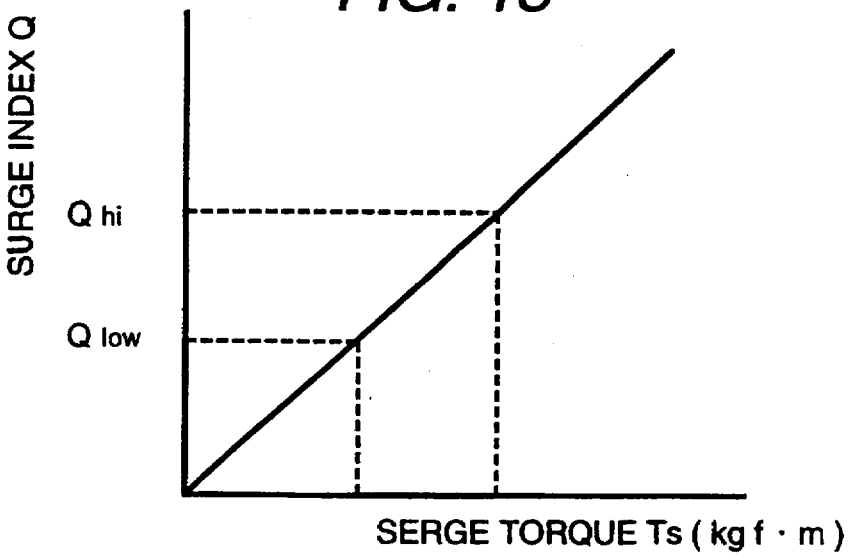
FIG. 17 is one example view showing a learning map according to a result of the variable control.
FIG. 18 is one example graph showing a relation between a surge index and a surge torque.

As to the surge index Q, as shown in FIG. 18, the judgment of the surge index Q is carried out by the provisions of a level of a surge index of $Q_{low}$ and a level of a surge index of $Q_{hi}$.

This surge index judgment is performed, after the calculation of the surge index Q in the block 26 of FIG. 2, the judgment is carried out whether the control of the target throttle valve opening degree is carried out as leaving the stable condition or the complementary control of the control constant group is carried out judging by the worse combustion condition or the combustion aggravation condition.

Next, a detail engine control will be explained referring to FIG. 7, FIG. 8, FIG. 9 and FIG. 10. In this engine control, the map is used as one of the control constant groups, namely the map variable control is carried out in this engine control.

Figure 7:
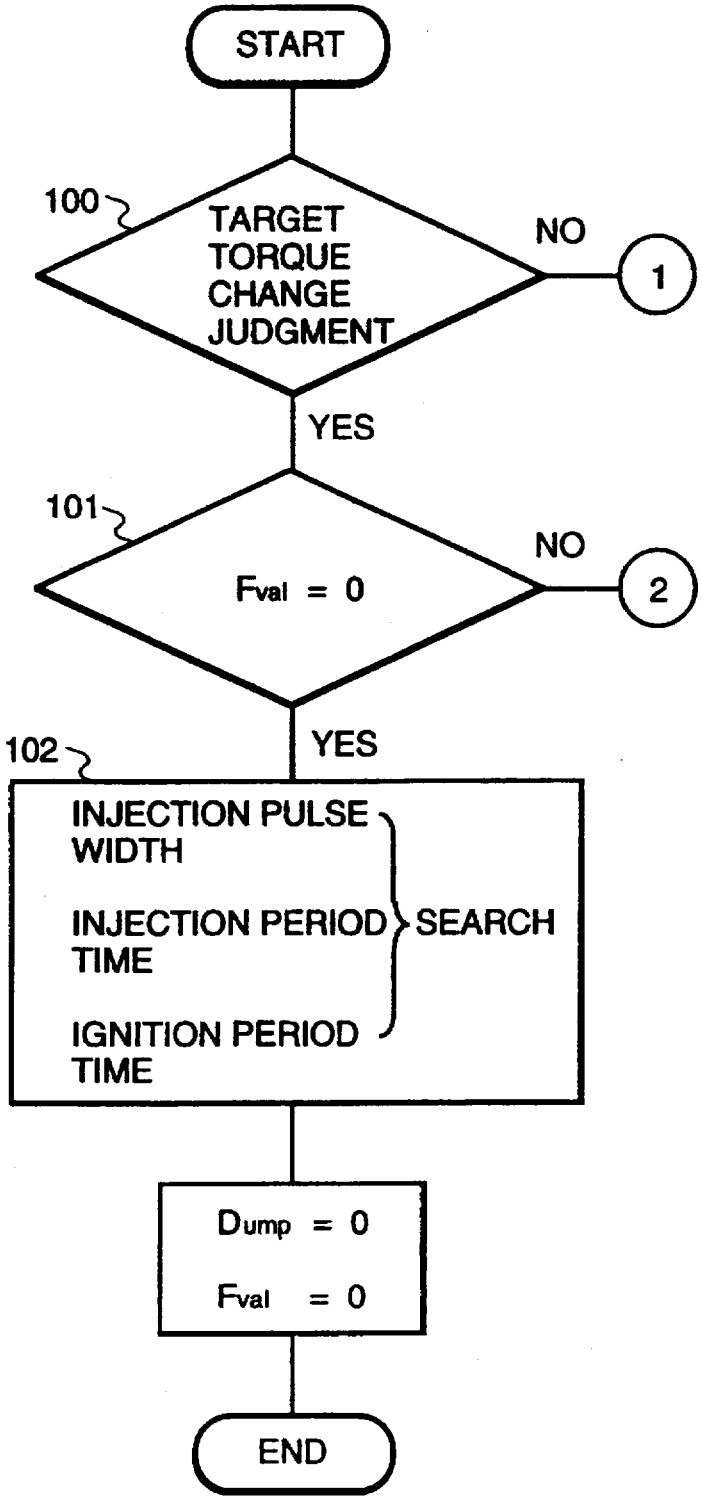
FIG. 7 is one flow chart showing one embodiment of a direct injection system engine controlling apparatus according to the present invention.

As shown in FIG. 7, in a step 100, an existence of the change of the target torque or "YES" or "No" of the change of the target torque is judged. In case of "NO", the judgment of the combustion condition which will be explained in a latter portion is carried out.

In case of "YES" or in case of the existence of the change of the target torque, in a step 101 a flag judgment ($F_{val}$) is carried out. This flag is one whether or not it is during a map variable control. The map variable control is a map complementary control which will be explained in a latter portion. In the map variable control, the map is not fixed but is varied by observing the engine condition.

In case of "NO", the map variable control is continuously carried out. This map variable control will be explained on and after FIG. 11. In case of "YES", in a step 102 the injection pulse width corresponded to the target torque, the injection period time corresponded to the target torque, and the ignition period time control constant corresponded to the target torque are searched and determined.

After that, the time number of the map variable control ($D_{ump}$) and the control flag ($F_{val}$) are cleared, the judgment routine finishes. This judgment routine is enable to down by a regular time sharing or an irregular time sharing.

Figure 8:
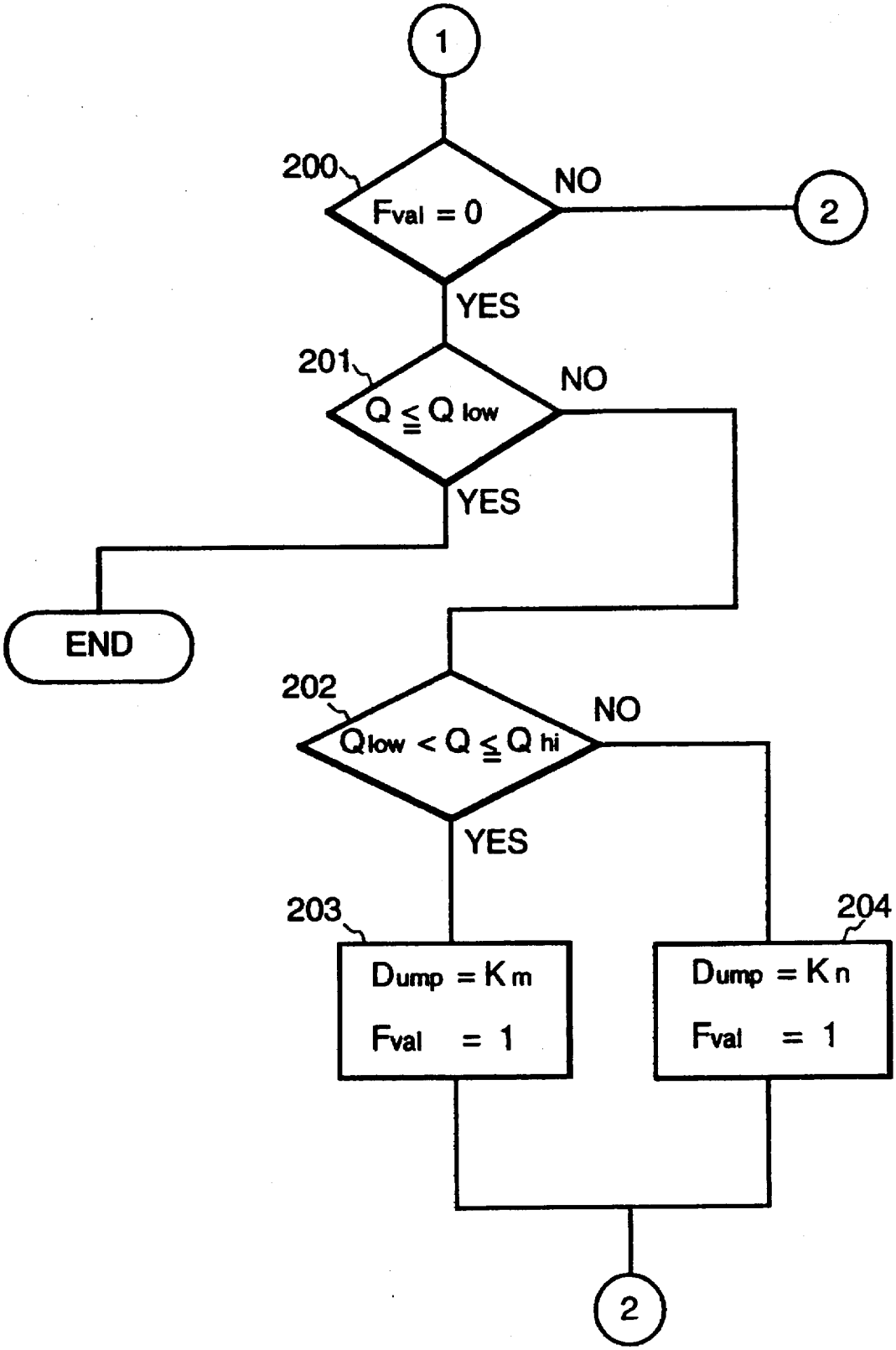
FIG. 8 is another flow chart showing one embodiment of a direct injection system engine controlling apparatus according to the present invention.

Next, in the step 100, after "NO" judgment it enters into the control shown in FIG. 8. In a step 200, the flag judgment ($F_{val}$) is carried out whether or not it is during the map variable control.

When it is under the map variable control, it enters into a control (2) shown in FIG. 8. Besides, in case that it is not under the map variable control, the level judgment of the surge index Q which is calculated in another routine is carried out in a step 201 and a step 202.

Figure 9:
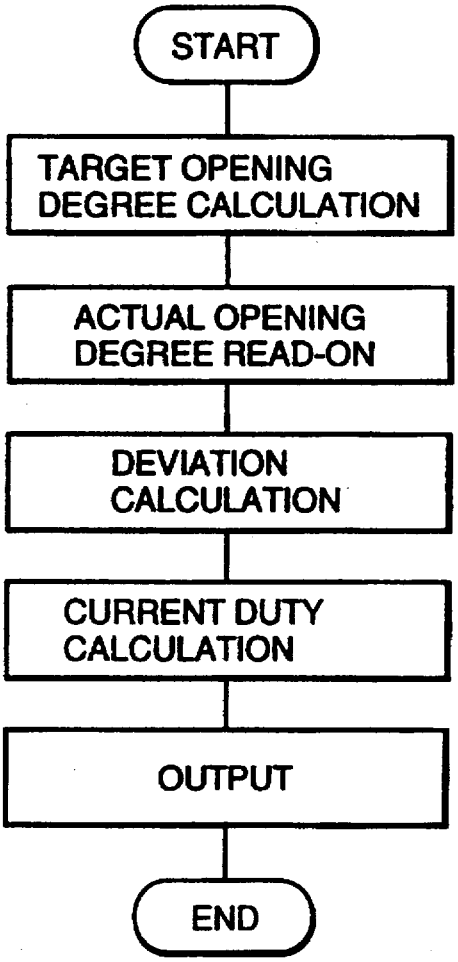
FIG. 9 is a further flow chart showing one embodiment of a direct injection system engine controlling apparatus according to the present invention.

In case "YES" judgement in the step 201, the surge index Q has a level lower than a predetermined level such as the surge level of $Q_{low}$ ($Q \leqq Q_{low}$) and it indicates as the stable combustion condition. Thereby, the map variable routine is finished and as shown in FIG. 9 the throttle valve control is continuously carried out. This throttle valve control corresponds to the control operation shown in a line (a) in FIG. 2.

The basis of the throttle valve control of the embodiment according to the present invention, as shown in FIG. 9, has a following construction.

In this construction shown in FIG. 9, against the target throttle valve opening degree of the throttle valve 5 requested by the block 23 shown in FIG. 2, a present actual throttle valve opening degree of the throttle valve 5 is read-in. A calculation about a deviation between the target throttle valve opening degree of the throttle valve 5 and the actual throttle valve opening degree of the throttle valve 5 is calculated.

After that a calculation about a current duty to the motor 20 for controlling the throttle valve 5 on the basis of the obtained deviation, and an output of the calculated current duty are carried out in the flow chart shown in FIG. 8.

In the surge index judgment in a step 202 shown in FIG. 8, in case of "YES" judgment the surge index Q exists between the surge index of $Q_{low}$ and the surge index of $Q_{hi}$ ($Q_{low} < Q \leqq Q_{hi}$) and the combustion condition being somewhat worse or going to be worse as the combustion condition is detected.

On the other hand, in case of "NO" judgment the surge index Q exists more than the surge index of $Q_{hi}$ ($Q > Q_{hi}$) and the worse combustion condition is indicated. In a step 203, and in a step 204, a number time of a variable $D_{ump}$ of the variable control is set with the surge level and at the same time a flag under the variable control is set.

By the setting of the above stated the variable $D_{ump}$ constant, the complementary control of the control constant group has a function of time, an abrupt constant change is avoided and as a result a smooth engine control is carried out.

Figure 10:
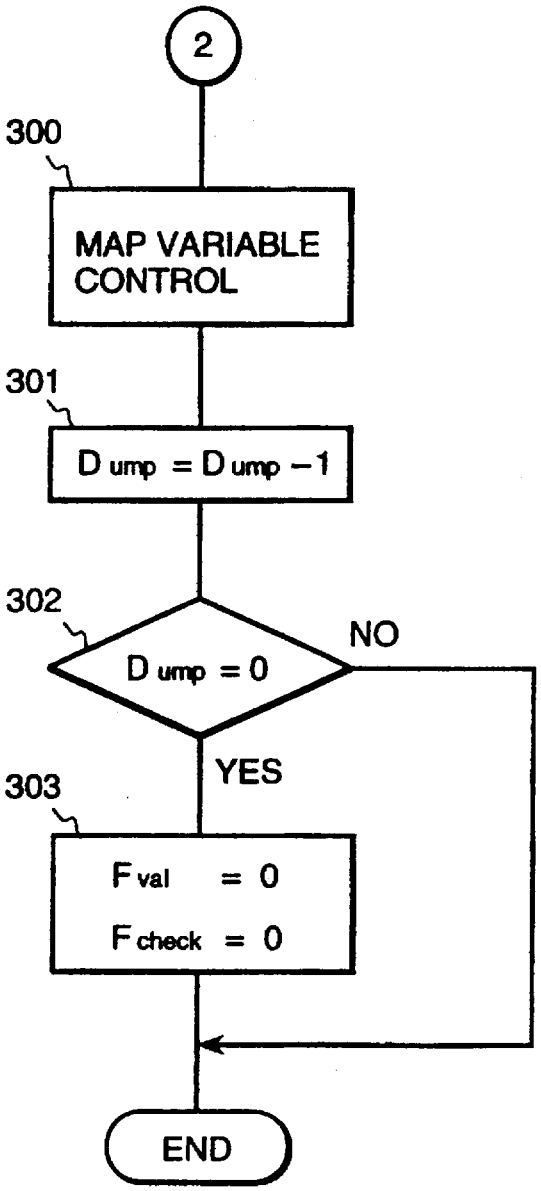
FIG. 10 is a furthermore flow chart showing one embodiment of a direct injection system engine controlling apparatus according to the present invention.

Next, the contents of the flow chart shown in FIG. 10 will be explained. In a step 300, the map variable control is carried out, after that in a step 301, a discrimination of the variable $D_{ump}$ being the time function is carried out. Since a predetermined number of times of the above routine is passed and thereby this construction has the time function.

In a step 302, in case that the variable $D_{ump}$ number of times is not zero "0" ($D_{ump}=0$) the processing is finished intact, however in case that the variable $D_{ump}$ number of times is zero "0" ($D_{ump}=0$) the control flag ($F_{check}$) is made zero "0" ($F_{check}=0$) and this routine is finished.

The map variable control will be explained in detail referring to FIGS. 11–15.

Figure 11:
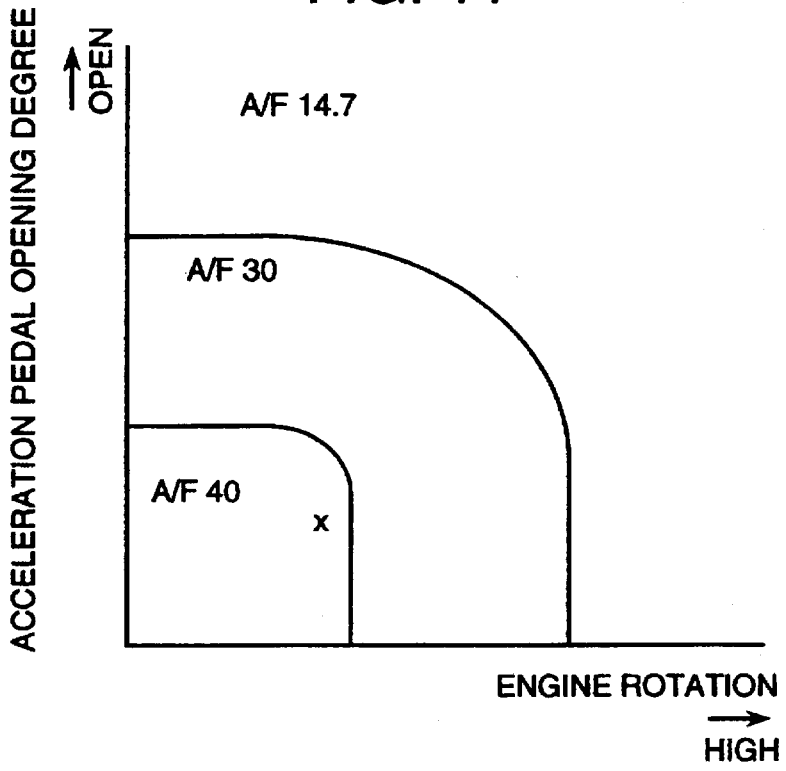
FIG. 11 is one variable control explanation graph showing one embodiment of a direct injection system engine controlling apparatus according to the present invention.

Now, a case where the engine operation is carried out at a point of a "x" mark in FIG. 11 will be considered. At this time, when the surge index Q exceeds over the surge index of $Q_{low}$ or the surge index of $Q_{hi}$, it shows that the combustion going to be worse at the "x" mark point.

Therefore, if the engine operation continues leaving as it is, a predetermined low fuel consumption is unable to be attained but in addition to this fact the driver is given an unpleasant feeling.

At the detected time point of the surge index of $Q_{low}$ or the surge index of $Q_{hi}$, the engine operation is performed under the target torque, namely the target air-fuel ratio having a value of 40 (A/F=40).

Figure 12:
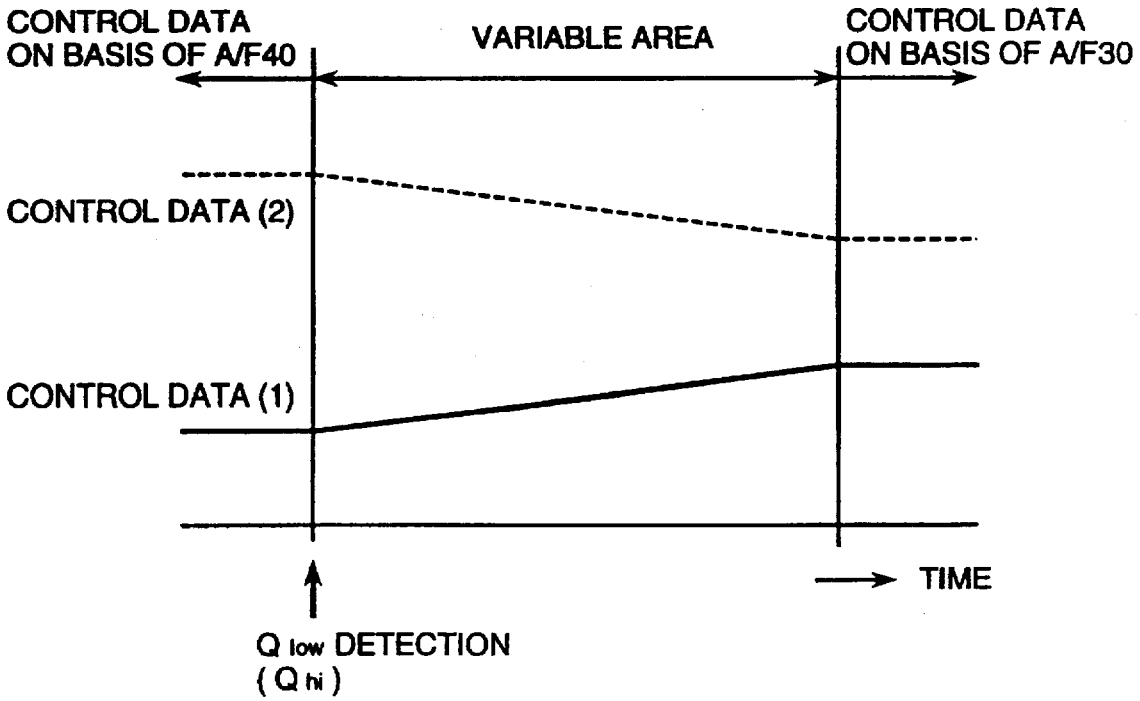
FIG. 12 is another variable control explanation graph showing one embodiment of a direct injection system engine controlling apparatus according to the present invention.

However, in case of the worse combustion condition detection, as shown in FIG. 12, a variable area is given, and then the engine control is carried out wherein under a predetermined time the target torque is transferred to a higher torque side of the control constant in which the target torque has a value of 30 (A/F=30).

Figure 13:
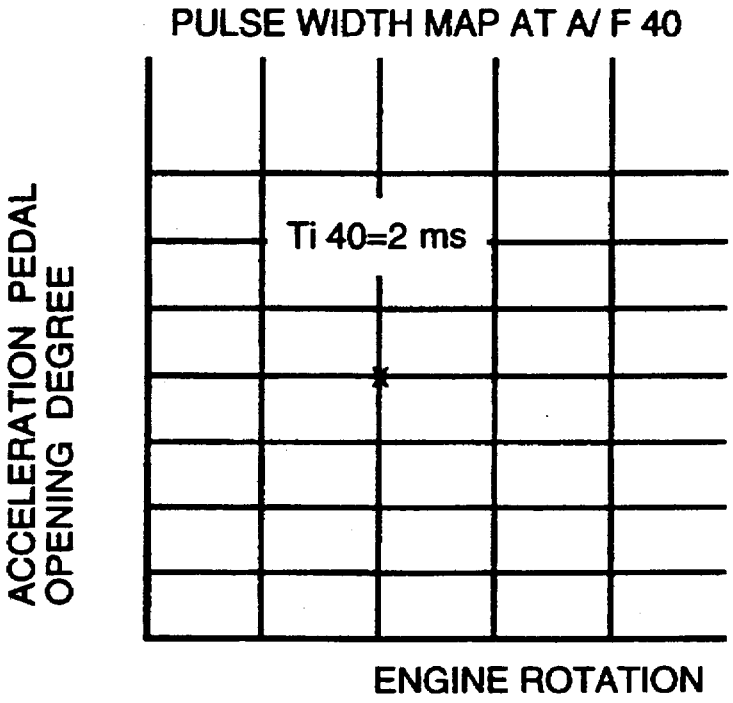
FIG. 13 is an injection pulse width map view at A/F=40 showing one embodiment of a direct injection system engine controlling apparatus according to the present invention.
Figure 14:
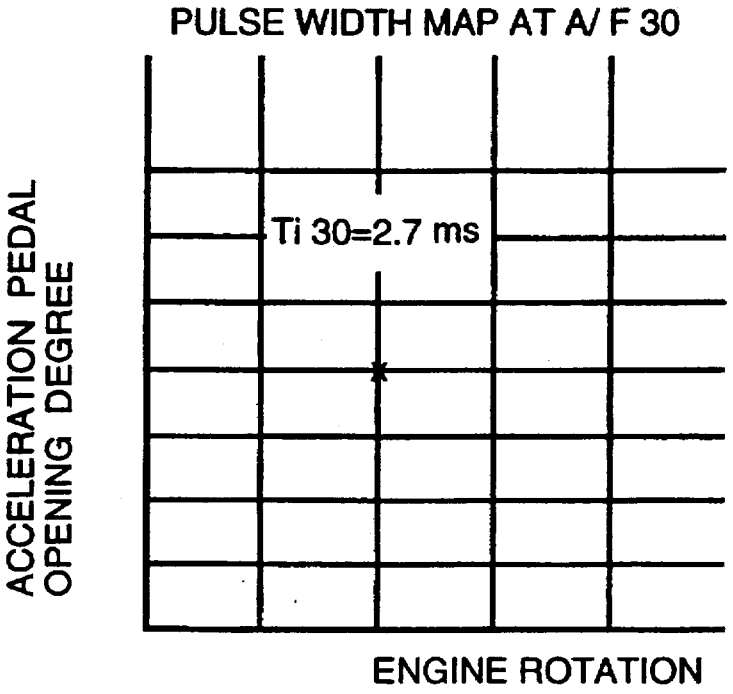
FIG. 14 is an injection pulse width map view at A/F=30 showing one embodiment of a direct injection system engine controlling apparatus according to the present invention.
Figure 15:
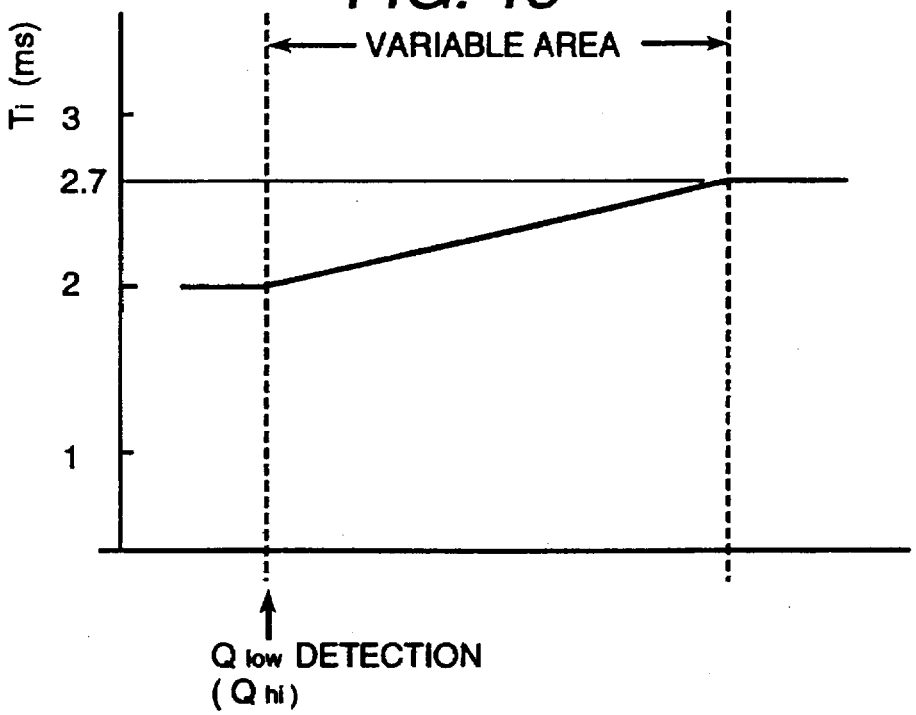
FIG. 15 is a further variable control explanation graph showing one embodiment of a direct injection system engine controlling apparatus according to the present invention.

In FIG. 13, FIG. 14 and FIG. 15, it will be concretely explained using the injection pulse width Ti, for example.

In these figures, Ti40 indicates an injection pulse width for generating the target air-fuel ratio of a value of 40 (A/F=40) and Ti30 indicates an injection pulse width for generating the target air-fuel ratio of a value of 30 (A/F=30), respectively.

At a point of the target air-fuel ratio having the value of 40 (A/F=40), the operation is performed under the injection pulse width of 2 ms (Ti=2 ms). And in case of the adaption of the surge detection, passing through the predetermined variable area, it is transferred with a step form to the injection width pulse Ti (Ti=2.7 ms) which corresponds to the target air-fuel ratio having the value of 30 (A/F=30).

Figure 16:
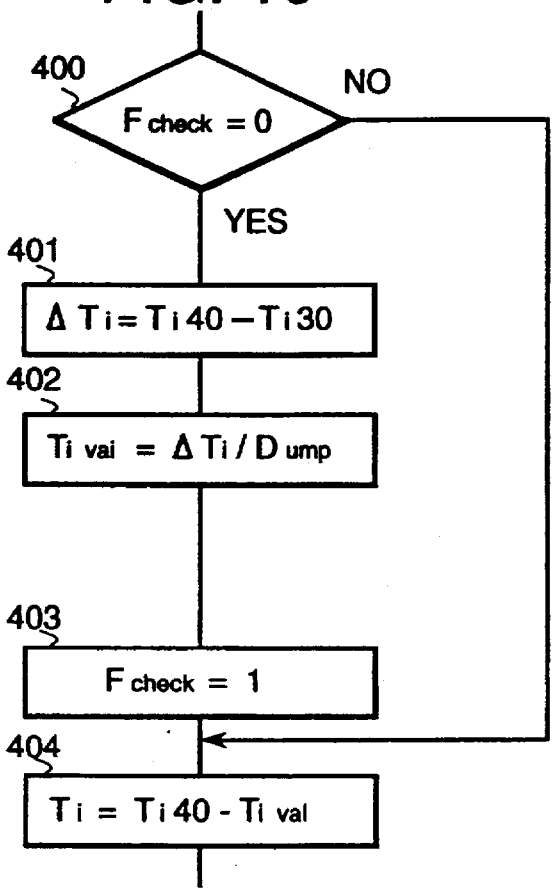
FIG. 16 is one variable control flow chart showing one embodiment of a direct injection system engine controlling apparatus according to the present invention.

FIG. 16 shows a detail flow chart of one example of the map variable control according to the present invention.

In a step 400, a judgment of a calculation finish flag of a variable amount $Ti_{val}$ of the injection pulse width is carried out. At a first passing through time, in a step 401, a difference (ΔTi) between the injection pulse width Ti40 (the injection pulse width of generating the target air fuel ratio of (A/F=40) and the injection pulse width Ti30 (the injection pulse width of generating the target air fuel ratio of (A/F=30) is calculated.

In a step 402, one time routine, namely one time injection pulse width variable amount $Ti_{val}$ of the injection pulse width Ti is calculated. This injection pulse width variable amount $Ti_{val}$ is necessary to carry out at a first time calculation and, in a step 403, the control flag ($F_{check}$) is set to not calculate a next time transfer.

In a step 404, a change of the injection pulse width Ti, which is outputted actually to the injector 9, is changed with the variable amount $Ti_{val}$ of the injection pulse width Ti to every this routine.

In the steps 203 and 204 of the flow chart shown in FIG. 8, the variable $D_{ump}$, being the variable variable is discriminated according to the worse condition of the surge index Q.

The above reason is that in case that the worse combustion condition is large, the variable control is finished and is transferred speedy to the high torque side and when the worse combustion condition is small the variable control is transferred slowly to the high torque side.

The control of the injection period time and the control of the ignition period time are carried out similarly to the above stated control of the injection pulse width.

FIG. 17 shows a leaning map of the target torque. At a "x" mark point in the leaning map when the above stated variable control is performed, the target torque in such an area is changed. A next time, in case that same operation condition occurs, the stable combustion can be down speedy.

According to the present invention, at the area for regarding a fuel consumption as important, at the area for reflecting the engine output by the driver's intention and at the area for considering a more high output and the engine protection, the controlling apparatus in the direct injection system engine can be realized in which the stratified combustion, the air-fuel ratio combustion corresponded to the normal lean burn combustion and the homogeneous stoichiometric combustion can be carried out stably and accurately, therefore the controlling apparatus suitable for the direct injection system engine can be provided.

Further, the controlling apparatus in the direct injection system engine can be provided wherein the stratified combustion condition can be maintained always with the stable combustion condition.

We claim:

1. A direct injection system engine controlling apparatus comprises:

a fuel supplying means for directly supplying a fuel to a cylinder of an engine;

an inhale air amount controlling means for controlling an amount of an inhale air which is inhaled into said cylinder;

an igniting means for igniting a mixture material of the fuel and the air in the cylinder; and a controlling means for controlling at least one of said fuel supplying means, said inhale air amount controlling means, and said igniting means; wherein the direct injection system engine controlling apparatus further comprises:

an operation condition detecting means for detecting an operation condition of said engine; and plural control constant groups for storing at least one of a constant, a map and a table for use in said controlling means;

in accordance with a detected operation condition detected by said operation condition detecting means, one of said control constant groups is selected.

2. A direct injection system engine controlling apparatus according to claim 1, wherein among said plural control constant groups, at least one is a control constant group for use in a stratified combustion control, or at least one is a control constant group for use in a stoichometric combustion control.

3. A direct injection system engine controlling apparatus comprises:

a fuel supplying means for directly supplying a fuel to a cylinder of an engine;

an inhale air amount controlling means for controlling an amount of an inhale air which is inhaled into said cylinder;

an igniting means for igniting a mixture material of the fuel and the air in the cylinder; and a controlling means for controlling at least one of said fuel supplying means, said inhale air amount controlling means, and said igniting means; wherein the direct injection system engine controlling apparatus further comprises:

plural control constant groups selected in accordance with a target torque, said target torque is determined from a rotation number of said engine and an acceleration pedal opening degree.

4. A direct injection system engine controlling apparatus according to claim 3, wherein said target torque is controlled by an inhale air flow amount to said engine.

5. A direct injection system engine controlling apparatus according to claim 1, wherein said plural control constant groups are carried a complementary operation in accordance with a combustion condition of said engine.

6. A direct injection system engine controlling apparatus according to claim 3, wherein said plural control constant groups are carried a complementary operation in accordance with a combustion condition of said engine.

7. A direct injection system engine controlling apparatus according to claim 5, wherein said complementary operation has a time function.

8. A direct injection system engine controlling apparatus according to claim 6, wherein said complementary operation has a time function.

9. A direct injection system engine controlling apparatus according to claim 4, wherein said air flow amount control is carried out by an electric means.

10. A direct injection system engine controlling apparatus according to claim 3, wherein a selection range based on said target torque is learned by an engine combustion condition.

11. A direct injection system engine controlling apparatus according to claim 5, wherein a selection range based on said target torque is learned by an engine combustion condition.

12. A direct injection engine controlling method, comprising the steps of:

directly supplying a fuel to a cylinder of an engine;

controlling an amount of air which is inhaled into said cylinder;

igniting a mixture material of the fuel and the air in the cylinder;

controlling at least one of a fuel supplying means, an inhale air amount controlling means, and an igniting means;

detecting an operation condition of said engine;

storing with control constant group at least one of a constant, a map and a table for use in said controlling; and selecting one of said control constant groups in accordance with a detected operation condition.

* * * * *